US005376299A

United States Patent [19]

Russell et al.

[11] Patent Number: 5,376,299

[45] Date of Patent: Dec. 27, 1994

[54] BODY MOULDING SOLUTION

[75] Inventors: Mark J. Russell; Michael J. Rickhuss, both of Mackay; Zygmunt J. Zielinski, Seaforth, all of Australia

[73] Assignee: MMZ Solutions Pty Ltd., Queensland, Australia

[21] Appl. No.: 85,881

[22] Filed: Jun. 30, 1993

[30] Foreign Application Priority Data

Jan. 21, 1993 [AU] Australia ..... 31936/93

[51] Int. Cl.[5] ..... C11D 7/24; C11D 7/26; C11D 7/50

[52] U.S. Cl. ..... 252/170; 252/162; 252/171; 252/364; 252/DIG. 8; 134/40

[58] Field of Search ..... 252/162, 170, 171, DIG. 8, 252/364; 134/40

[56] References Cited

U.S. PATENT DOCUMENTS

| | | | |
|---|---|---|---|
| Re. 29,649 | 5/1978 | Farnsworth | 252/171 |
| 1,415,605 | 5/1922 | Newbury | 252/170 |
| 1,461,170 | 7/1923 | Wright | 252/170 |
| 1,758,317 | 5/1930 | Hardy | 252/170 |
| 2,004,628 | 6/1935 | Keen et al. | 252/170 |
| 2,098,607 | 11/1937 | Allen et al. | 252/143 |
| 2,262,508 | 11/1941 | Little | 252/171 |
| 2,356,254 | 8/1944 | Lehmann | 252/170 |
| 5,011,621 | 4/1991 | Sullivan | 252/364 |
| 5,018,422 | 5/1991 | Coe, Jr. | 84/275 |

FOREIGN PATENT DOCUMENTS

| | | | |
|---|---|---|---|
| 3913911 | 11/1990 | Germany | 252/171 |
| 1-121367 | 5/1989 | Japan . | |
| 8617 | 9/1905 | United Kingdom | 252/170 |
| 1260378 | 9/1986 | U.S.S.R. | 252/170 |

OTHER PUBLICATIONS

Levitt, *Oils, Detergents and Maintenance Specialties,* vol. 2, Formulary Chemical Publishing Co., Inc. NY 1967, pp.64–65.

Material Safety Data Sheet for Shell Bitmen Cutter printed Jun. 1, 1993.

*The Merck Index* Tenth Edition, Merck & Co., Inc. NJ 1983 pp. 761, 1261, 1262.

*Primary Examiner*—Linda Skaling

*Attorney, Agent, or Firm*—John E. Reilly

[57] ABSTRACT

A solution for use in removing the double sided adhesive tape from mouldings used on motor vehicles and the like. The solution comprises (a) 50–94% by weight of a refined petroleum product which is a low boiling point distillate of paraffinic, naphthenic and aromatic fractions, (b) 5–50% by weight of oil of turpentine, (c) 1–30% by weight of an oil based surface active agent, and (d) $<1\%$ by weight of one or more optional additives selected from deodorizing agents, perfumes, colourants, and inert liquid extenders.

3 Claims, No Drawings

BODY MOULDING SOLUTION

This invention relates to a body moulding solution and more particularly, to the repair of motor vehicles, boats, caravans and like conveyances which have body mouldings. Body moulding are the strips of rubber, metallic or painted embellishments which are fitted to the exterior surfaces of the conveyance and which often have the added function of providing a degree of protection from damage which would otherwise occur from bumping or similar light contact against the exterior surface. Such body mouldings are generally lo fitted with a double sided adhesive tape. The adhesive used is of sufficient gripping power to prevent easy removal of the moulding from the conveyance, but which provides maximum adherence between the moulding and the tape itself, to thus enable the moulding to be peeled from the conveyance while the tape remains adhered to the moulding.

In the repair of conveyances such as motor vehicles, the body moulding is generally the first item to be removed from the damaged panel. The moulding is often suitable for re-use once the panel has been fixed and refitted, however, before the moulding can be re-used, the double sided adhesive tape must be removed. This is usually a time consuming and expensive operation. There are basically four ways of doing this, viz by grinding, using a solvent, hot blowing or using a razor blade or a thumb.

Grinding with a grinding wheel can frequently damage the moulding or leave a bad surface on the moulding which means that the moulding cannot be properly re-fitted and is subject to falling off. Grinding is, furthermore, a messy and polluting operation and requires the use of a solvent to clean the area which has been ground. Solvents are not only a safety hazard due to fire and fumes, but can only be used on non-painted mouldings. Overall, grinding is a time consuming and expensive operation.

The use of solvents per se is often resorted to in order to prevent any damage to the moulds occurring. Large quantities have to be applied to be effective which results in wastage, as a good portion cannot be re-used, and they are a high fire risk. It is also a messy operation requiring a large work area, and operators get their hands covered in glue and solvent. Furthermore, as mentioned above, solvents are limited in their use to non-painted mouldings since they tend to damage paint.

Hot blowers are machines used to heat the adhesive strip to soften the adhesive and thereby permit the strip to be pulled from the molding. Such blowers are expensive and frequently damage the moulding. Hot blowers are not in wide use.

Scraping with a razor blade or thumb has the disadvantage that the operator can end up with blisters or cut fingers. It is also a time-consuming process and therefore expensive.

OBJECT OF THE INVENTION

It is therefore an object of the invention to provide a new manner of removing the double sided adhesive tape from motor vehicle and like mouldings, which obviates or at least minimizes the aforementioned disadvantages.

SUMMARY OF THE INVENTION

According to the present invention, there is provided a solution for use in removing the double sided adhesive tape from mouldings and which has the further property of conditioning the moulding for re-use. The solution comprises an admixture of ingredients which synergistically function to give the desired properties and advantages. The mixture comprises (a) 50–94% by weight of a refined petroleum product which is a low boiling point distillate of paraffinic, naphthenic and aromatic fractions, (b) 5–50% by weight of oil of turpentine, (c) 1–30% by weight of a surface active agent, and (d) <1% by weight of one or more optional additives selected from deodorizing agents, perfumes, colourants, and inert liquid extenders.

In use, the body moulding with the double sided adhesive tape is immersed in a container of the solution and let stand for at least three hours. The body moulding is then removed from the solution and the double sided tape is peeled off by hand in one action. The moulding is then dried with a rag and a new double sided adhesive tape is applied prior to refixing the moulding to the vehicle.

The solution is reusable, wastage is negligible, the moulding is reconditioned, the moulding remains undamaged, there is a lower fire risk than with conventional solvents and minimal time is involved by the operator as he can be attending to other matters while the solution is working.

DESCRIPTION OF PREFERRED EMBODIMENTS

The refined petroleum product can be an aviation fuel such as Jet A or Jet A-1 fuel manufactured according to ASTM D 1655; or a bitumen cutter. The preferred aviation fuel is Shell Jet A-1 and the preferred bitumen cutter is Shell Bitumen Cutter. Both these products are kerosene based and are manufactured by The Shell Company of Australia Limited. The former has a specific gravity of 0.775–0.83 @ 15° C., a boiling point of 175°–325° C., a vapour pressure of 3.76–11.30 mm Hg @ 38° C., a vapour density >1 (Air=1), 100% volatiles, a flash point of 40°–60° C., an autoignition of 230° C., a LEL of 0.7% u/v and a UEL of 6.0% u/v. The latter has a specific gravity of 0.795 @ 15° C., a boiling point of 155°–230° C., a vapour pressure of 6.0mmHg @ 25° C., a vapour density>1 (Air=1), evaporation rate <0.8 (n-BuAc=1), a flash point of 38° C., an autoignition of 230° C., a LEL of 0.7% u/v and a UEL of 6.0%.

The oil of turpentine is preferably a mineral turpentine such as PETROPINE (Registered Trade Mark), a product manufactured by Mobil Australia Pty Ltd. This product has a specific gravity of 0.814 @ 15° C., a refractive index of 1.461 @ 20° C., a flash point of 31° C., an aniline point of 22, 48% vol. aromatics, 51.9% vol. saturates, 0.1% vol. olefins, and distillation ° C. IBP=145, 10%=153, 20%=158, 50% 32 162, 90%=180, FBP=+30).

The surface active agent is selected to reduce the interfacial tension between the refined petroleum product and the oil of turpentine, while promoting a sheen on the product to which it is applied. To this end, products such as vegetable oils having similar properties to linseed and castor oils, are preferred. The most preferred surfactant is castor oil itself. Castor oil is a non-drying oil having a specific gravity of 0.945–0.965 @ 25° C., a saponification value of 178, iodine value 85, fp-10° C., a flash point of 229° C., and an autoignition temperature of 448° C.

The optional additives are most suitably chosen for safety and deodorant masking characteristics. For safety purposes, a dye may be incorporated. For deodorant masking, a perfume may be incorporated. Generally, there is a single perfume additive present in the composition. The preferred perfumes are GUMLEAF AROMATICS/PINEAPPLE FRAGRANCE (manufactured by Gumleaf Aromatics Australia Pty Ltd), TEATREE OIL, EUCALYPTUS OIL and DEODALL no. 1 (manufactured by Givaudan-Roure Pty Limited, Australia). These products mask a wide range of odours and are particularly suitable for masking kerosene odours. DEODALL no. 1 comprises a complex proprietary mixture of fragrance materials and has a specific gravity of 0.875 @25° C., a refractive index of 1.473 @ 20° C. and a flash point of 100° C.

A preferred embodiment of the invention is described in the following example.

EXAMPLE 1

A solution was prepared by blending the following ingredients together in a container in the stated quantities:

| | |
|---|---|
| Bitumen Cutter[1] (kerosene) | ≈ 93% by wgt |
| Mineral Turpentine[2] | ≈ 5% by wgt |
| Castor oil[3] | ≈ 2% by wgt |
| Deodall no. 1[4] | ≈ 0.1% by wgt |

[1]Product of The Shell Company of Australia Pty Ltd
[2]Product of Mobil Australia Pty Ltd
[3]Product of Faulding Pharmaceutical
[4]Product of Givaudan-Roure Pty Ltd.

The solution was poured into a trough with a cover and a rubber moulding having a double sided adhesive tape, was totally immersed therein. After three hours, the moulding was removed from the trough and allowed to drain. It was found that the tape could easily be peeled from the moulding by hand. Inspection of the moulding revealed no damage whosoever to the moulding but rather it was observed that the rubber had been rejuvenated. Furthermore, only a negligible amount of solution had been lost when the moulding was removed from the trough.

EXAMPLE 2

A solution was prepared by blending the following ingredients together in a container in the stated quantities:

| | |
|---|---|
| Bitumen Cutter[1] | ≈ 94% by wgt |
| Mineral Turpentine[2] | ≈ 5% by wgt |
| Linseed oil[3] | ≈ 1% by wgt |
| Gumleaf Aromatics - Pineapple Fragrance[4] | ≈ 0.1% by wgt |

[1]Product of The Shell Company of Australia Pty Ltd
[2]Product of Mobil Australia Pty Ltd
[3]Product of Faulding Pharmaceutical
[4]Product of Gumleaf Aromatics Australia Pty Ltd The same properties were noted as in Example 1.

We claim:

1. A solution for use in removing adhesive tape from motor vehicle moulding and motor vehicle like mouldings, said solution consisting essentially of:

(a) about 93%–94% by weight of kerosene;
(b) about 5% by weight of oil of turpentine;
(c) about 1%–2% by weight of a surface active agent selected from the group consisting of linseed oil and castor oil; and
(d) less than about 1% by weight of a perfume.

2. A solution as claimed in claim 1, which consists essentially of:

(a) about 93% by weight of kerosene;
(b) about 5% by weight of oil of turpentine wherein said oil of turpentine is mineral turpentine;
(c) about 2% by weight of castor oil; and
(d) about 0.1% by weight of a perfume.

3. A solution as claimed in claim 1, which consists essentially of:

(a) about 94% by weight of kerosene;
(b) about 5% by weight of oil of turpentine wherein said oil of turpentine is mineral turpentine;
(c) about 1% by weight of linseed oil; and
(d) about 0.1% by weight of a perfume.

* * * * *